United States Patent [19]

Gorman

[11] Patent Number: 4,955,924

[45] Date of Patent: Sep. 11, 1990

[54] WINDOW GLAZE CLEANING

[76] Inventor: Daniel J. Gorman, 740 Lonsdale Rd., Ottawa, Ontario, Canada, K1K 0K2

[21] Appl. No.: 365,426

[22] Filed: Jun. 13, 1989

[30] Foreign Application Priority Data

Jun. 14, 1988 [CA] Canada ..... 569468

[51] Int. Cl.[5] ..... A47L 1/00

[52] U.S. Cl. ..... 15/103; 15/50.1

[58] Field of Search ..... 15/103, 49 R, 49 C, 15/50 R, 50 C, 302, 220 R, 220 A

[56] References Cited

U.S. PATENT DOCUMENTS

| | | | |
|---|---|---|---|
| 3,461,476 | 8/1969 | North | 15/103 |
| 3,646,630 | 3/1972 | Russell | 15/103 |
| 3,983,591 | 10/1976 | Ohtaki et al. | 15/103 |
| 3,999,242 | 12/1976 | Maruyama et al. | 15/103 |

*Primary Examiner*—Edward L. Roberts

*Attorney, Agent, or Firm*—Francis W. Lemon

[57] ABSTRACT

A window glaze cleaning device comprises an outer frame and an inner frame which have magnets attached so that when they are placed face-to-face on opposite glazings of a window, the outer frame can be moved, by movement of the inner frame, over the outer glazing. The frames have bearings, e.g. air bearings to reduce friction, and the outer frame, which is counter-weighted, has nozzles for spraying cleaning liquid on to the outer glazing, a scrubber which may be positioned for cleaning the outer glazing, and a wiper blade which may be positioned for removing the cleaning liquid therefrom as is done in conventional window cleaning. The outer frame is counter weighted by pulleys on rocker arms which move the outer frame away from the window when it is to be repositioned.

5 Claims, 5 Drawing Sheets

Figure 1:
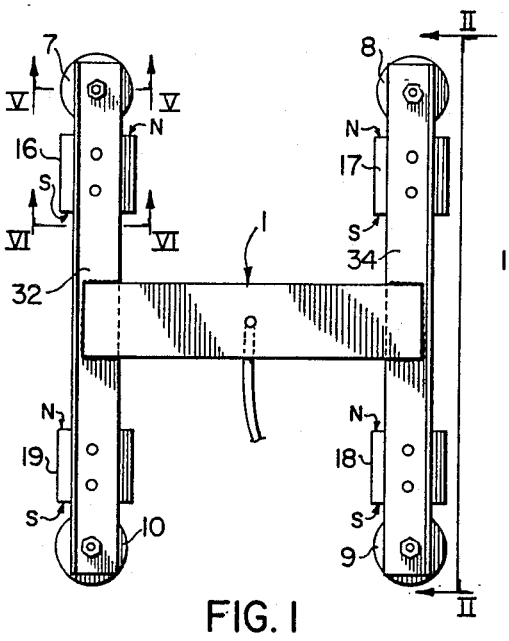

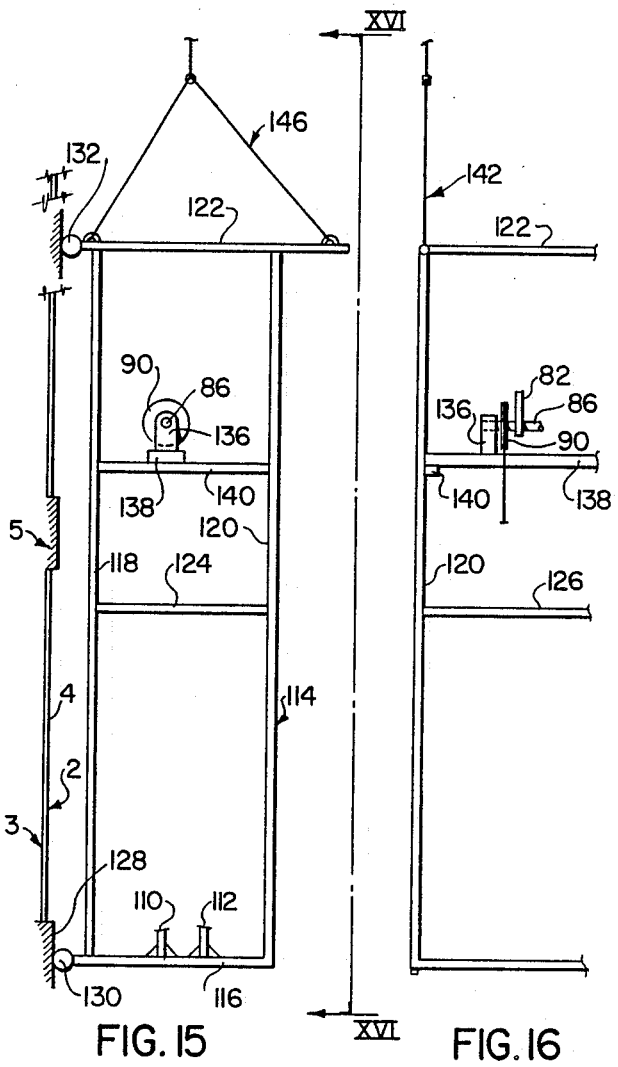
FIG. 15
FIG. 16
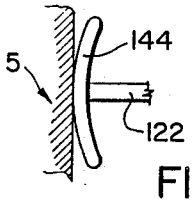
FIG. 17

WINDOW GLAZE CLEANING

This invention relates to a window glaze cleaning device.

The conventional method of cleaning the outer glazed surfaces of the sealed windows of high rise buildings is by means of workers in a cradle which the workers can raise or lower on the side of the building. This method of cleaning the outer glazed surfaces is inefficient and hazardous.

There is a need for a window glaze cleaning device for cleaning glazed surfaces that are not readily accessible, such as the glazed outer surfaces of sealed windows of high rise buildings, which is efficient and which does not require workers on, for example, the outside of the building.

According to the present invention there is provided a window glaze cleaning device, comprising (a) an outer frame for, in operation, being placed on an outer, glazed surface of a window, (b) an inner frame for, in operation, being placed on an inner glazed surface of that window face-to-face with the outer frame, (c) at least three outer bearings attached to the outer frame for, in operation, holding the outer frame closely spaced from the outer glazed surface, (d) at least three inner bearings attached to the inner frame for, in operation, holding the inner frame closely spaced from the inner glazed surface, (e) first magnet means attached to the outer frame, (f) second magnet means attached to the inner frame and oriented to present opposite polarities when, in operation, placed face-to-face for magnetic attraction with the first magnet means, whereby the inner and outer frames will be held face-to-face, by the magnetic attraction, closely spaced from their respective glazed surfaces, (g) a wiper blade assembly attached to and extending across the outer frame for, in operation, wiping cleaning liquid from the outer glazed surface, (h) nozzle means attached to the outer frame for, in operation, attachment to a source of cleaning liquid and directing that cleaning liquid into the path of the wiper blade assembly, and (i) a support assembly for in operation, supporting the weight of the outer frame for movement of the outer frame relative to the outer glazed surface by the magnetic attraction between the first and second magnet means when the inner frame is moved from position on the inner glazed surface to another position thereon.

In some embodiments of the present invention the outer and inner bearings are air bearings.

In other embodiments of the present invention the outer and inner frames are H-shaped frames, four outer bearings are provided, one at the extremity of each of the arms of the outer, H-shaped frame, four inner bearings are provided, one at the extremity of each of the arms of the inner, H-shaped frame, the first magnet means comprises four magnets, one attached to each arm of the outer, H-shaped frame, the second magnet means comprises four magnets, one attached to each arm of the inner, H-shaped frame, the wiper blade assembly comprises two retractable arms which are pivotally attached to the sides of the outer, H-frame, a wiper blade extending between and connected to the free ends of the retractable arms, and means are provided, for, in operation, moving the retractable arms to place the wiper blade into engagement with the outer glazed surface at a position beyond the extremities of the outer, H-frame.

Other embodiments of the present invention may comprise a bar pivotally attached at each end to the outer extremities of the retractable arms, the wiper blade is mounted along one side of the arm, a scrubber is mounted along another side of the arm, and means are provided for rotating the bar for positioning the wiper blade or the scrubber for contact with the outer glazed surface.

In other embodiments of the present invention the support assembly comprises a rack, two cables each supporting an upper side of the outer frame, two retractable rocker arms are mounted on an upper portion of the rack, for each retractable rocker arm, two pulleys mounted for rotation at each end of that retractable rocker arm and having one of the two cables passing over the V's of both pulleys to extend downwardly therefrom to free ends, means attached to the free ends for resiliently supporting the weight of the outer frame, and means for rocking the rocker arms to move the outer frame to and from the outer glazing.

In this specification, outer glazed surface means the glazed surface on the opposite side of a window from that which is readilly accessible.

Figure 2:
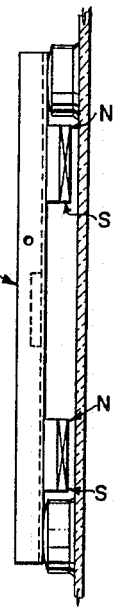
Figure 3:
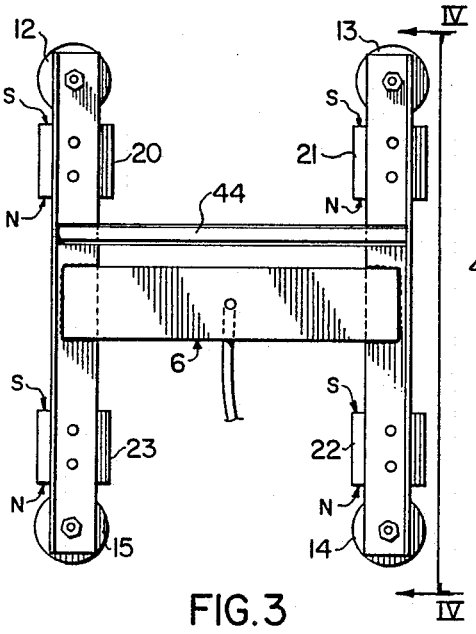
Figure 4:
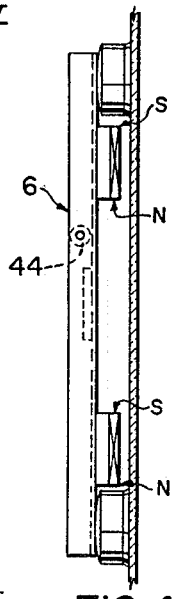
Figure 5:
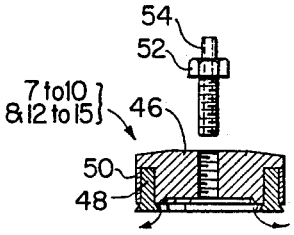
Figure 6:
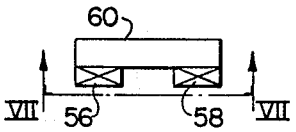
Figure 7:
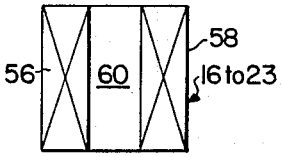
Figure 8:
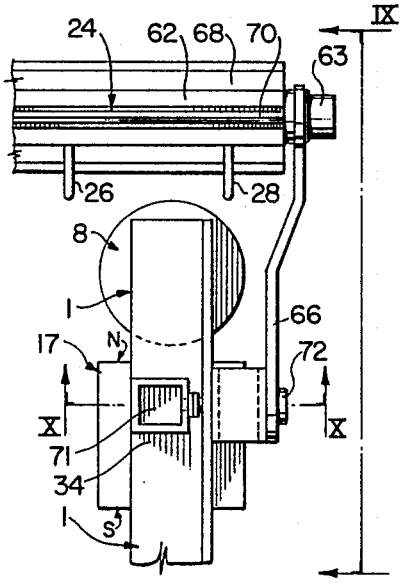
Figure 9:
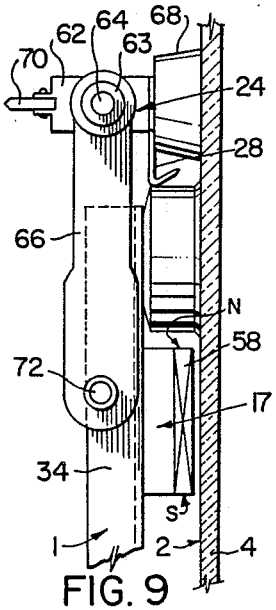
Figure 10:
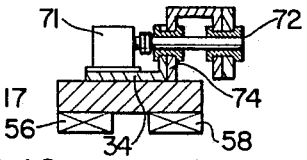
Figure 11:
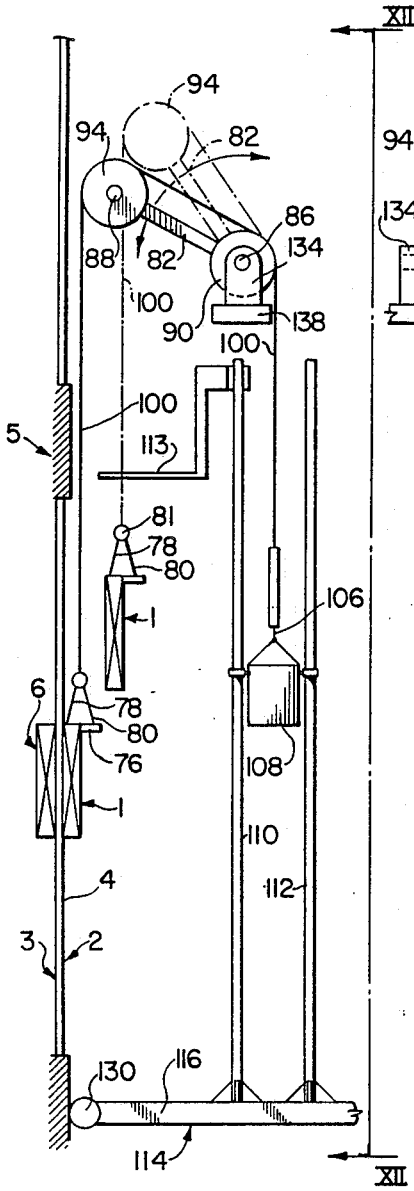
Figure 12:
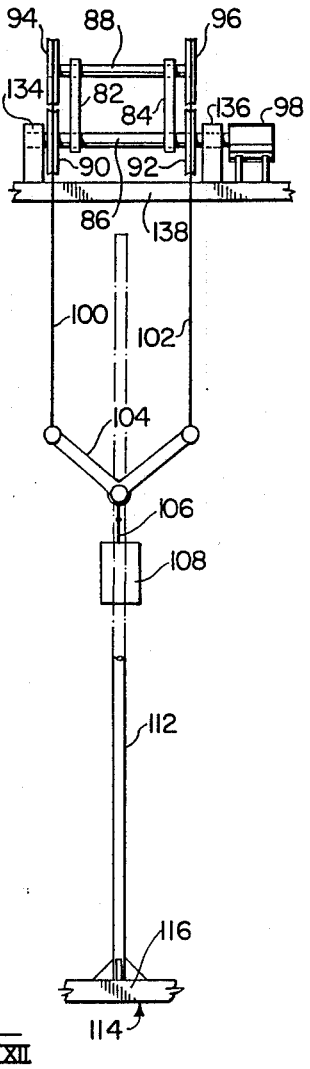
Figure 13:
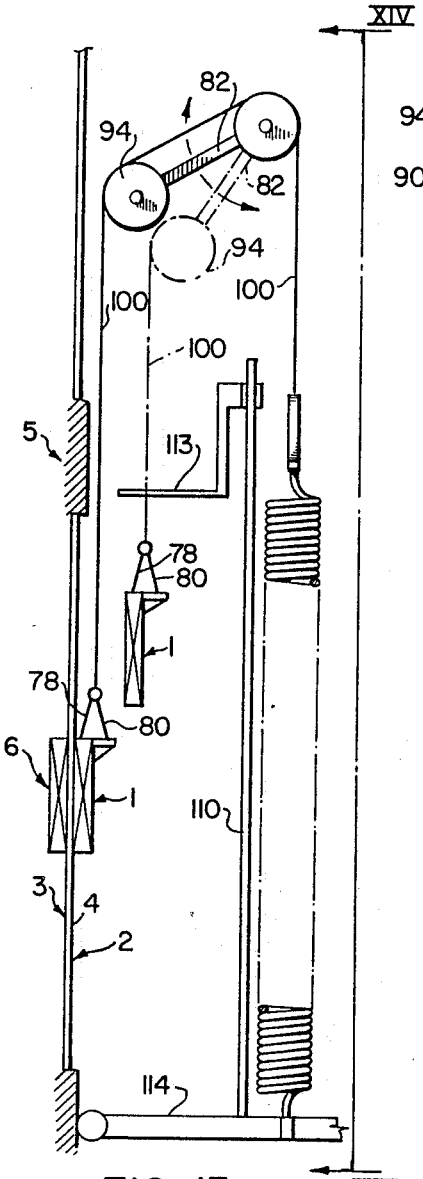
Figure 14:
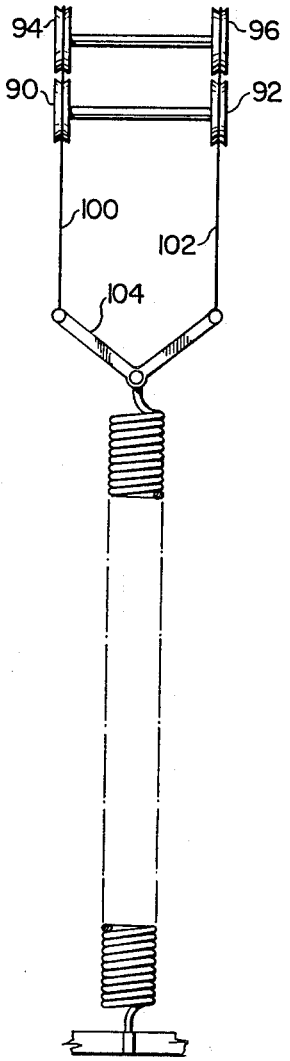

In the accompanying drawings which illustrate, by way of examples, embodiments of the present invention, FIG. 1 is a side view of an outer frame assembly of a window glaze cleaning device, FIG. 2 is an end view along II—II, FIG. 1, FIG. 3 is a side view of an inner frame assembly of a window glaze cleaning device, FIG. 4 is an end view along IV—IV, FIG. 3, FIG. 5 is a partly sectioned, exploded view along V—V, FIG. 1 of an air bearing, FIG. 6 is an end view along VI—VI, FIG. 1, of a permanent magnet assembly, FIG. 7 is a side view along VII—VII, FIG. 6, FIG. 8 is a side view of an end portion of a wiper blade assembly, FIG. 9 is an end view along IX—IX, FIG. 8, FIG. 10 is a partly sectioned end view along X—X, FIG. 8 with the wiper blade assembly removed, FIG. 11 is an end view of a support device for an outer frame assembly, FIG. 12 is a side view along XII—XII, FIG. 11, of the counterweight, FIG. 13 is an end view of a different support device to that shown in FIGS. 9 and 10, FIG. 14 is a side view along XIV—XIV, FIG. 13, of the counterbalance spring, FIG. 15 is an end view of a suspension rack for an outer frame assembly, FIG. 16 is a side view along XVI—XVI, FIG. 15, of a portion of the rack, and FIG. 17 is a side view of a skate member.

In this embodiment of the present invention, the outer and inner frames are identical and so the frame depicted in FIGS. 1 and 2 is used in both instances.

Referring now to FIGS. 1 to 10, there is shown a window glaze cleaning device, comprising:

(a) an outer frame, which is H-shaped and is generally designated 1 (FIGS. 1 and 2), for, in operation, being placed on an outer, glazed surface 2, FIG. 11, of a window 4 of a building 5, (b) an inner frame, which is H-shaped and generally designated 6 (FIGS. 3 and 4), for, in operation, being placed on an inner glazed surface 3 of that window face-to-face with the outer frame 1, (c) at least three outer bearings, in this embodiment there are four outer air bearings generally designated 7 to 10, attached to the extremities of the arms of the H-shape of the outer frame 1 for, in operation, holding the outer frame closely spaced from the outer glazed surface, (d) at least three inner bearings, in this embodiment there are four inner air bearings which are generally designated 12 to 15 and attached to the extremities of the arms of the H-shape of the inner frame 6, for, in operation, holding the inner frame closely spaced from the inner glazed surface, (e) first magnet means, in this embodiment four pairs of permanent first magnets generally designated 16 to 19, attached to the outer frame 1, (f) second magnet means, in this embodiment four pairs of permanent second magnets generally designated 20 to 23, attached to the inner frame 6 and, as shown in FIGS. 1 to 4, oriented to present opposite polarities when, in operation, placed face-to-face for magnetic attraction with the first magnet means, whereby the inner and outer frames, 1 and 6 respectively, will be held face-to-face (as shown in FIG. 11), by the magnetic attraction, closely spaced from their respective glazed surfaces 2 and 3, (g) a wiper blade assembly, generally designated 24, partly shown in FIGS. 8 and 10, attached to and extending across the outer frame 1 for, in operation, wiping cleaning liquid from the outer glazed surface 2, (h) nozzle means, in this embodiment a plurality of nozzles, two of which are shown and designated 26 and 28, FIGS. 8 and 9, equally spaced across the wiper blade assembly 24, and attached to the outer frame 1 via the wiper blade assembly for, in operation, attachment to a source (not shown) of cleaning liquid and directing that cleaning liquid into the path of the wiper blade assembly 24, and (i) a support assembly, generally designated 30, FIG. 11 and 12, for, in operation, supporting the weight of the outer frame 1 for movement of the outer frame relative to the outer, glazed surface 2 by the magnetic attraction between the first and second magnet means, i.e. the pairs of permanent magnets 16 to 19 and 20 to 23 respectively, when the inner frame 6 is moved from one position on the inner, glazed surface 3 to another position thereon.

The outer frame 1 comprises two thin aluminum angles 32 and 34 with a thin aluminum cross-bar 36 welded to them.

The inner frame 6 also comprises two thin aluminum angles 38 and 40 with a thin aluminum cross-bar welded to them. The inner frame 6 has a handle 44.

The air bearings 7 to 10 and 12 to 15 each comprise a cylindrical plug 46 of polytetrafluoroethylene, an annular skirt 48 of a soft plastics material, a metal band 50 tightened over the skirt 48 to hold the skirt 48 in position on the plug 46, and a hollow, piped, screw threaded bolt 52. The bolt 52 is used to clamp the plug 46 to the angle 32, 34, 38 or 40 while the pipe 54 is used to supply pressurized air to the inside of the skirt 48.

The first and second pairs of permanent magnets 16 to 19 and 20 to 23 respectively, each comprise a pair of permanent magnets 56 and 58, FIGS. 6 and 7, and a steel backing plate 60 which closes portions of the magnetic circuits of the permanent magnets 56 and 58 away from the inner glazed surface 2.

In this embodiment of the present invention two wiper blade assemblies, such as wiper blade assembly 24, are provided one at the top and the other at the bottom of the outer frame 1. Each wiper blade assembly, FIGS. 8 and 9, comprises a cross-bar 62 pivotable by a reversible motor 63 and a pivot at each end, such as pivot 64, relative to the free ends of arms, such as arm 66, a scrubber in the form of a squeegee 68 and a scraper blade 70 mounted on the cross-bar 62. The nozzles, such as nozzles 26 and 28 are also mounted on the cross-bar 62. The arms, such as arm 66, are pivotable by reversable motors 71 and pivots, such as pivot 72, FIG. 10, relative to brackets, such as bracket 74 attached to the outer frame 1.

The support assembly 30, FIGS. 11 and 12, comprises two brackets at the upper corners of the outer frame 1, one of which is shown and designated 76, two wire cables, such as cables 78 and 80, attached to each of the brackets, such as bracket 76, a cross bar 81 attached to the cables, such as cables 78 and 80, two retractable rocker arms 82 and 84, a fixed shaft 86 having the arms 82 and 84 mounted thereon for rotation therewith, a movable shaft 88 mounted on the arms 82 and 84, two pulleys 90 and 92 mounted for rotation on the fixed shaft 86, two pulleys 94 and 96 mounted for rotation on the movable shaft 88, a reversible step motor 98 for rotating the arms 82 and 84 from the position shown in full in FIG. 11 to the retracted position shown chain dotted, and wire cables 100 and 102 passing over the pulleys 90, 94 and 92, 96 respectively and attached at one end to the cross bar 81, a yoke 104 attached to the other ends of the wire cables 100 and 102, a wire cable 106 depending from the yoke 104, a counterweight 108 suspended by the wire cable 106, guide rails 110 and 112 for guiding vertical movements of the counterweight 108, a pronged nesting rake 113 for nesting the wire cable 100 in the retracted position, shown chain dotted in FIG. 11, and a support rack generally designated 114, FIGS. 15 and 16.

The suspension rack 114, FIGS. 15 and 16, has a base 116 with the guide rails 110 and 112 mounted thereon, upwardly extending corner members, two of which are shown and designated 118 and 120, an upper rectangular frame 122 and ties, such as those designated 124 and 126. The suspension frame rests against the side of a building 128 by four rollers, two of which are shown and designated 130 and 132.

Referring now to FIGS. 11 and 12, 15 and 16, the shaft 86 carrying the pulleys 82 and 84 is mounted in two bearings 134 and 136 which, together with the reversible step motor 98 are mounted on a platform 138. The platform 138 is supported on the rack 114 at each end by beams, one of which is shown and designated 140.

The rack 114 is supported at each side by suspension cable assemblies, one of which is shown and designated 142. The suspension cable assemblies, such as that designated 142, are raised, lowered and positioned along the wall of a building by a similar mechanism (not shown) to that already used to perform these functions for a window cleaner's cradle.

In operation, with the outer frame 1, assembled as described with reference to FIGS. 1, 2, 5 to 7, 9 to 12 and 15 and 16, the apparatus is lowered down the side of the building 5, by lowering the rack 114, FIGS. 15 and 16, with the arms, such as 66, FIGS. 8 and 9, and 82 and 84, FIGS. 11 and 12, retracted.

When the frame 1 is adjacent the uppermost window 4 to be cleaned the arms 82 and 84 are moved forward by the motor 98 to bring the outer frame 1 close to the outer glazed surface 2. With the air bearings 7 to 10 and 12 to 15 being fed with pressurized air at about one atmosphere gauge (one kilogram per square centimeter), the inner frame 6 is placed on the inner glazed surface 3 and moved into face-to-face position with the outer frame 1 so that the magnetic couplings between the respective pairs of permanent magnets 16 to 23 pull the air bearings 7 to 10 and 12 to 15 in to sliding engagement with the outer and inner glazed surfaces 2 and 3 respectively.

The motors 63 at the top of the frame 1 are then energized, e.g. by remote radio control, to bring the squeegee 68 at the top of the frame 1 into the operable position shown in FIGS. 8 and 9, and then the motors 71 at the top of the frame are energized to bring the squeegee 68 into contact with the outer glazed surface 2.

Cleaning liquid is then sprayed by the nozzles 26, FIGS. 8 and 9, into the path of the squeegee 68 as the squeegee 68 is moved up and down and laterally by movement of the inner frame 6 to scrub the upper portion of the glazed outer surface 2. When the upper portion of the glazed outer surface 2 has been scrubbed, the arms 66 are retracted, the wiper blade 70 is moved into the operable position, and then the wiper blade 70 is moved by movement of the inner frame 6 to wipe the cleaning liquid from the cleaned upper portion of the glazed outer surface 2.

The motors 63 at the top of the frame 1 are then energized to move the arms 66 to the retracted position, and then the same procedure is used to clean the lower portion of the outer glazing 2 using the equivalent cleaning parts located at the bottom of the frame 1.

When the outer glazing 2 of the uppermost window 4 has been cleaned, the inner frame 6 is withdrawn and the motor 98 is used to retract the outer frame 1 so that it can be moved by the rack 114 to the next window immediately below the one that has just been cleaned. It should be noted, that in the retracted position, the outer frame 1 is held against lateral sway by the cable 1 nesting in between prongs of the rake 113.

When the whole of outer glazings 4 of the vertical row of windows 2 have been cleaned the rack is positioned outside the outer glazing 4 of the top window 2 of the next vertical row of windows to clean the outer glazings 4 of that row of windows 4, and so on until the outer glazings 4 of the whole of that side of the building have been cleaned.

The rack 114 can then be positioned on another side of the building for cleaning the outer glazings 4 of the windows on that side of the building in the same manner as has been previously described.

In different embodiments of the present invention the arms 66 are extended to pivot about the center of the outer frame 1 so that after use at upper end of the outer frame 1 the squeegee 68 and scraper blade 70 can be flipped from the upper end of the outer frame to the lower end of the outer frame 1 for use at this position. This engagement eliminates the duplication of components and reduces the total weight of the cleaning device.

In FIGS. 13 and 14, similar parts to those shown in FIGS. 11 and 12 are designated by the same reference numerals and the previous description is relied upon to describe them.

In FIGS. 11 and 12 the outer frame 1 is counterbalanced by the weight 108 while in FIGS. 13 and 14 the outer frame 1 is counterbalanced by a resilient, long, coiled, tension spring having a high aspect ratio.

Another difference is that the arms, such as 82, are tilted downwardly to the retracted position.

In different embodiments of the present invention the air bearings 7 to 10, FIG. 1, and 12 to 15, FIG. 2, are replaced by swivelling casters, however, with dirty glazed surfaces where undue friction is encountered, air bearings to reduce the friction to no discernible effect on moving the outer frame.

In other embodiments of the present invention the pairs of permanent magnets 16 to 19, FIG. 1, and 20 to 23, FIG. 2, are replaced by electromagnets.

In other embodiments of the present invention the scrubber 68 may be, for example, a brush.

It is within the scope of the present invention to use outer and inner frames which are triangular in outline with bearings at the vertices of the triangles and preferably a single magnet and wiper blade located near the center of gravity of each frame and extending parallel to and at least equidistant to the length of the base of the triangle for stability.

In some embodiments of the present invention a reversible fan is mounted on the outer frame for moving the outer frame towards or away from the outer glazing.

The pressurized air for the air bearings may be provided by a flexible air pipe to the outer frame or by a pressure vessel on the outer frame.

The outer frame may carry a counterweight to shift its center of gravity outwardly thereby moving the outer frame inwardly towards recessed windows.

The impact of the outer frame, when being brought into contact with the outer glazed surface, may be buffered by using small mechanical dampers on the outer frame.

FIG. 17 shows a skate member 144 which may be used instead of the rollers 130 and 132 shown in FIG. 15.

I claim:

1. A window glaze cleaning device, comprising:

(a) an outer frame for, in operation, being placed on an outer, glazed surface of a window, (b) an inner frame for, in operation, being placed on an inner glazed surface of that window face-to-face with the outer frame, (c) at least three outer bearings attached to the outer frame for, in operation, holding the outer frame closely spaced from the outer glazed surface, (d) at least three inner bearings attached to the inner frame for, in operation, holding the inner frame closely spaced from the inner glazed surface, (e) first magnet means attached to the outer frame, (f) second magnet means attached to the inner frame and oriented to present opposite polarities when, in operation, placed face-to-face for magnetic attraction with the first magnet means, whereby the inner and outer frames will be held face-to-face, by the magnetic attraction, closely spaced from their respective glazed surfaces, (g) a wiper blade assembly attached to and extending across the outer frame for, in operation, wiping cleaning liquid from the outer glazed surface, (h) nozzle means attached to the outer frame for, in operation, attachment to a source of cleaning liquid and directing that cleaning liquid into the path of the wiper blade assembly, and (i) a support assembly for, in operation, supporting the weight of the outer frame for movement of the outer frame relative to the outer glazed surface by the magnetic attraction between the first and second magnet means when the inner frame is moved from position on the inner glazed surface to another position thereon.

2. A device according to claim 1, wherein the outer and inner bearings are air bearings.

3. A device according to claim 1, wherein the outer and inner frames are H-shaped frames, four outer bearings are provided, one at the extremity of each of the arms of the outer, H-shaped frame, four inner bearings are provided, one at the extremity of each of the arms of the inner, H-shaped frame, the first magnet means comprises four magnets, one attached to each arm of the outer, H-shaped frame, the second magnet means comprises four magnets, one attached to each arm of the inner, H-shaped frame, the wiper blade assembly comprises two retractable arms which are pivotally attached to the sides of the outer. H-frame, a wiper blade extending between and connected to the free ends of the retractable arms, and means are provided, for, in operation, moving the retractable arms to place the wiper blade into engagement with the outer glazed surface at a position beyond the extremities of the outer, H-frame.

4. A device according to claim 3, further comprising a bar pivotally attached at each end to the outer extremities of the retractable arms, the wiper blade is mounted along one side of the arm, a squeegee is mounted along another side of the arm, and means are provided for rotating the bar for positioning the wiper blade or the squeegee for contact with the outer glazed surface.

5. A device according to claim 1, wherein the support assembly comprises a rack, two cables each supporting an upper side of the outer frame, two retractable rocker arms are mounted on an upper portion of the rack, for each retractable rocker arms, two pulleys mounted for rotation at each end of that retractable rocker arm and having one of the two cables passing over the V's of both pulleys to extend downwardly therefrom to free ends, means attached to the free ends for resiliently supporting the weight of the outer frame, and means for rocking the rocker arms to move the outer frame to and from the outer glazing.

* * * * *